US007878753B2

(12) United States Patent
Kielian et al.

(10) Patent No.: US 7,878,753 B2
(45) Date of Patent: Feb. 1, 2011

(54) VEHICLE BODY SHELL ROTATION APPARATUS

(75) Inventors: Douglas James Kielian, 711 W. Saunders Ave., Lincoln, NE (US) 68521; Stephanie Sue Kielian, 711 W. Saunders Ave., Lincoln, NE (US) 68521

(73) Assignees: Douglas James Kielian, Lincoln, NE (US); Stephanie Sue Kielian, Lincoln, NE (US)

( * ) Notice: Subject to any disclaimer, the term of this patent is extended or adjusted under 35 U.S.C. 154(b) by 75 days.

(21) Appl. No.: 12/144,592

(22) Filed: Jun. 23, 2008

(65) Prior Publication Data

US 2009/0003982 A1 Jan. 1, 2009

Related U.S. Application Data

(60) Provisional application No. 60/937,390, filed on Jun. 27, 2007.

(51) Int. Cl.
*B66F 7/22* (2006.01)

(52) U.S. Cl. ..... 414/800; 414/678; 269/17

(58) Field of Classification Search ..... 414/678, 414/800; 269/17
See application file for complete search history.

(56) References Cited

U.S. PATENT DOCUMENTS

| | | | | |
|---|---|---|---|---|
| 1,288,138 | A | 12/1918 | Nicoson | |
| 1,566,506 | A | 5/1922 | Resse et al. | |
| 1,507,911 | A * | 9/1924 | Eichman | 269/99 |
| 1,615,860 | A * | 2/1927 | Williams | 269/76 |
| 2,583,877 | A * | 1/1952 | Peyron | 269/61 |
| 2,931,644 | A * | 4/1960 | Kenworthy | 269/17 |
| 3,087,631 | A * | 4/1963 | Kocher | 414/678 |
| 3,734,466 | A | 5/1973 | Mason | |
| 3,868,101 | A * | 2/1975 | Nozaki et al. | 269/25 |
| 4,039,115 | A * | 8/1977 | Randolph et al. | 228/44.5 |
| 4,491,307 | A * | 1/1985 | Ellefson | 269/55 |
| 4,533,127 | A * | 8/1985 | Hawkins | 269/17 |
| 4,599,034 | A | 7/1986 | Kennedy et al. | |
| 4,686,925 | A | 8/1987 | Stuck | |
| 4,813,843 | A | 3/1989 | Gilmour et al. | |
| 5,238,361 | A | 8/1993 | Liqui | |
| 5,328,161 | A | 7/1994 | Stuck | |
| 5,564,683 | A | 10/1996 | Stuck | |
| 2005/0212191 | A1 * | 9/2005 | McKelvie et al. | 269/17 |

* cited by examiner

*Primary Examiner*—Saúl J Rodríguez
*Assistant Examiner*—Jonathan D Snelting

(57) ABSTRACT

A rotatable apparatus for repairing and restoring vehicle body shells including a pair of vertically positioned hoops placed in a parallel relation mounted to the body shell for rotation about a horizontal axis. A plurality of connecting members attached in a spoke-like manner to support the body shell. A pair of generally stationary roller-bases supports the hoop assembly and facilitates rotation. The roller-bases include foot-operated brakes to prevent rotation of the assembly. A jacking-arm device facilitates the transfer of the assembly from the roller-bases to the removably connected upright rolling supports for traversing an area.

1 Claim, 6 Drawing Sheets

VEHICLE BODY SHELL ROTATION APPARATUS

CROSS-REFERENCE TO RELATED APPLICATIONS

This application claims the benefit of Provisional Patent Application No. 60/937,390 filed Jun. 27, 2007 by the present inventors.

FEDERALLY SPONSORED RESEARCH

Not Applicable

SEQUENCE LISTING OR PROGRAM

Not Applicable

BACKGROUND OF THE INVENTION

1. Field of the Invention

This invention relates to an apparatus for holding and rotating an automobile body or other vehicle to any position about a horizontal axis and to lock in place with a foot-operated brake to facilitate restoration or repairs.

2. Background of the Invention

When repairing and restoring automobile bodies it is often necessary to perform major repairs to the lower part of the vehicle body as well as the underside due to rust or other damage. It is difficult to perform these repairs when the vehicle is in an upright position because access to the damaged areas is limited and often requires the worker to repair the damaged area by crawling underneath the vehicle.

One approach for gaining access to the lower and underside of a vehicle is to raise the vehicle on a hydraulic lift or jack stands. This may give the worker more space to do the repairs, however he is still required to reach over his head and work at an uncomfortable angle.

Another technique is to tilt or rotate the vehicle horizontally to expose the underside for better access, as disclosed in U.S. Pat. No. 5,238,361 issued Aug. 24, 1993 to Liquid. This device has a lifting mechanism and swivel skids shaped in a quarter circles. The vehicle is attached to the device at the wheel hubs on one side of the vehicle. When the lifting arm is raised the vehicle is tilted along the swivel skids to rotate the vehicle approximately 90°. This method allows for access to the underside of the vehicle, but it does not rotate the vehicle a full 360°. It also requires that the vehicle is still assembled with its suspension intact. Often during a vehicle restoration, the vehicle is disassembled to the body shell with the suspension removed.

Another approach disclosed in U.S. Pat. No. 4,599,034 issued Jul. 8, 1986 to Kennedy, et al., is to mount the vehicle or vehicle body shell at both ends to a frame assembly and attach to a pair of upstanding mounting posts. The vehicle can then be raised up along the posts and rotated on the rotatable journal that connects the frame and the mounting posts. This apparatus adds to the overall length of the complete assembly, therefore taking up more space in the repair shop, it also does not allow for 360° rotation. There are also other similar rotational apparatus that exist and consist of the rotatable mounting frames that attach to brackets mounted to the front and rear end of the vehicle. While these inventions do allow for 360° rotation, they often put undue stress on the center of the chassis of the vehicle by literally hanging the vehicle from both ends with no support given to the center of the vehicle. This is especially a problem for vehicles with a lot of rust in the floor and rocker panel areas which are therefore weakened, and to convertibles with no roof structure to help support the center of the vehicle. These inventions also require a lower connecting bar to tie the mounting frames together to keep them from collapsing in when the vehicle is lifted and rotated. This lower connecting bar can be an obstacle that impedes movement around the vehicle while performing repairs. It also makes the apparatus difficult to move around uneven terrain or to load onto a car trailer. These inventions are also difficult to rotate with one person and require the worker to move from the workspace having to go to the end of the vehicle in order to lock the vehicle in place to stop its rotation.

Another approach is seen in U.S. Pat. No. 5,328,161 issued Jul. 12, 1994 to Stuck which teaches a devise including a pair of rings connected to a jet ski. The rings each have a flat edge on the top and bottom which provides a supporting surface when the jet ski is either upright or inverted. This invention is simple and inexpensive, but it requires space for the apparatus to travel across the floor when rotated. It also allows for full rotation, but it is only stationary when the jet ski is upright or inverted.

SUMMARY

The invention is directed to a rotary apparatus that enables the user to mount a vehicle body shell in the apparatus and rotate it 360° for use in the repair and restoration of a vehicle.

An elevated vehicle body shell is encircled by two large vertically oriented hoops that are generally parallel and placed around the front and rear suspension area of the body shell. The body shell is attached to the hoops by bolting, welding, clamping or otherwise securing a plurality of various lengths of metal tubing or other connecting members which may connect from the mounting tabs on the inner periphery of the hoop to the structure of the inner chassis of the body shell using existing bolt holes or other mounting points. The connecting members are attached in a spoke-like fashion supporting the body shell in or near the center of the hoops using the approximate center of gravity of the body shell. Since the suspension areas are designed to support the weight of the entire vehicle, they are a strong and structurally sound area to mount the assembly to and therefore will not put any undue stress on the center of the chassis. The vehicle itself provides the connection from one hoop to the other so there are no additional obstacles to interfere with and the assembly can be adapted for various lengths of vehicles. The apparatus does not extend past the length of the vehicle body shell and therefore does not take any additional space in the repair shop.

The roller-bases are placed under the hoops which allow the vehicle body and apparatus to rotate around a horizontal axis while the roller-bases remain in a generally stationary position on the ground. The two roller-bases support roller bearing wheels at each end which make up the contact surface for the hoops and allow them to roll freely. The roller bases also contain a foot-operated brake at each wheel, which stops the rotating apparatus and locks it in any fixed position. The four foot-operated brakes enables the worker to prevent rotation of the apparatus without needing to move from his working area. Only one brake is needed to be engaged to stop rotation and lock the apparatus in any fixed position. The worker can then unlock the foot brake and rotate the apparatus easily and without assistance simply by grabbing one of the hoops and manually rotating the assembly. The user has greater leverage by using the hoop as a large handle and does not need to touch the vehicle itself in order to rotate the assembly.

There are four upright rolling supports that attach to the lower section of the hoops and enable the apparatus to traverse around an area or up onto a car trailer. A jacking arm fits into the tabs in the lower section of the hoops and a floor jack is used to raise and lower it onto the bases for rotation, or to raise it up off of the roller-bases to connect with the upright rolling supports. The entire apparatus can be readily disassembled for storage and shipment.

This invention is not limited in use for automotive vehicle body shells only. This apparatus could also be used in the manufacture or repair of: vehicular trailers, boat shells, jet ski and snowmobile shells, vehicle frames, and the fuselage of an airplane body.

DRAWINGS—FIGURES

DETAILED DESCRIPTION

The vehicle body shell rotation apparatus of the invention comprises of two hoops 1 that are positioned vertically and parallel to each other, each rotatably supported on a generally stationary roller-base assembly 2.

Figure 1:
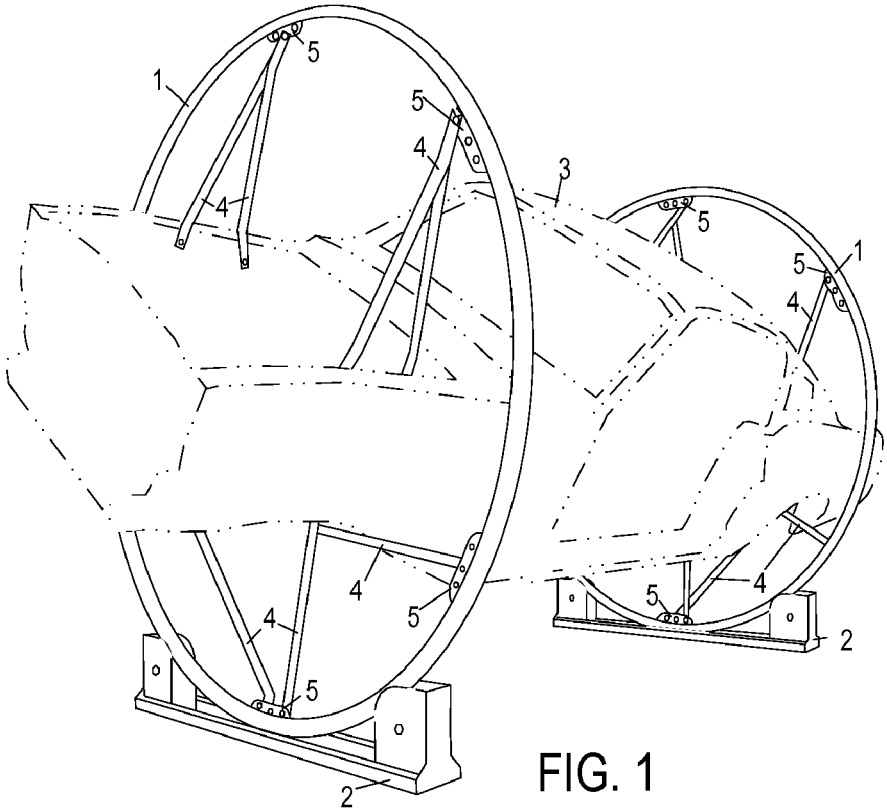
FIG. 1 is an overall perspective view of the apparatus including the roller-bases as associated with a vehicle body shell.
Figure 2:
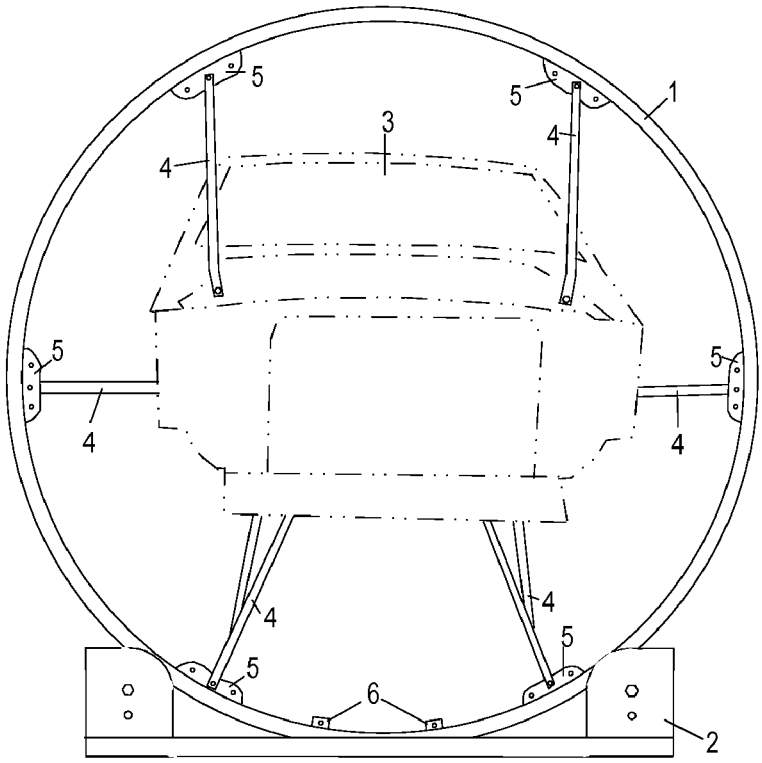
FIG. 2 is a front end view of one end of the apparatus.

The vehicle body shell 3 is substantially secured in the apparatus by a plurality of connecting means 4 which removably connect the inside edge of the hoop to various mounting points on the vehicle body shell 3 with one hoop positioned generally around the rear suspension area, and the other hoop parallel to the first hoop and positioned generally around the front suspension area, or front firewall, as best illustrated in FIG. 1. As shown in FIG. 2, the vehicle body shell 3 is positioned within the hoops 1 so the general center of gravity is aligned with the center point of the hoop allowing the apparatus to be rotated about its center axis. The connecting means 4 are spaced apart linking the hoop 1 to the vehicle body shell 3 in a spoke-like fashion.

Figure 3:
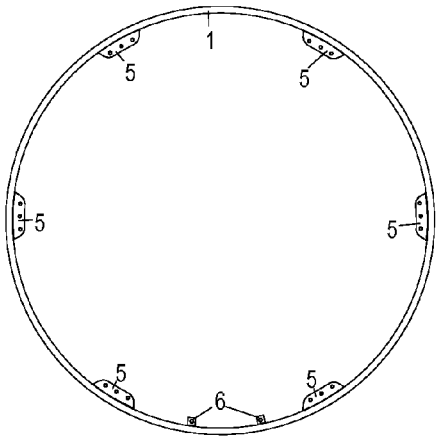
FIG. 3 is a front view of one of the hoops.
Figure 6:
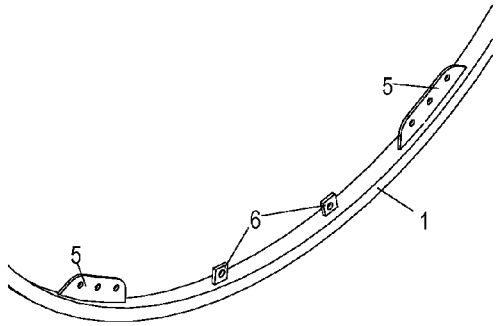
FIG. 6 is a perspective view of the lower portion of one of the hoops.

The hoops 1 may comprise of metal tubing rolled into equal circles with the outside edge smooth so that it may be rolled over a surface such as a floor. As best shown in FIGS. 3 and 6, the hoops 1 have a plurality of mounting tabs 5 welded or otherwise secured on or in various locations along the inside edge of the hoop. The mounting tabs 5 have a plurality of holes to accommodate bolts to attach the connecting means 4 to the apparatus. The connecting means 4 may comprise of metal tubing that may be bolted on one end to the mounting tabs 5 and then bolted, clamped or otherwise secured to the vehicle body shell 3 at various points to support the vehicles weight. The jacking-arm tabs 6 which are welded or otherwise secured to the lower inside edge of the hoop 1 provide the holding means for the jacking-arm 18 to enable lifting of the apparatus to place on the roller-bases 2 or to install the upright rolling support assemblies 17.

Figure 4:
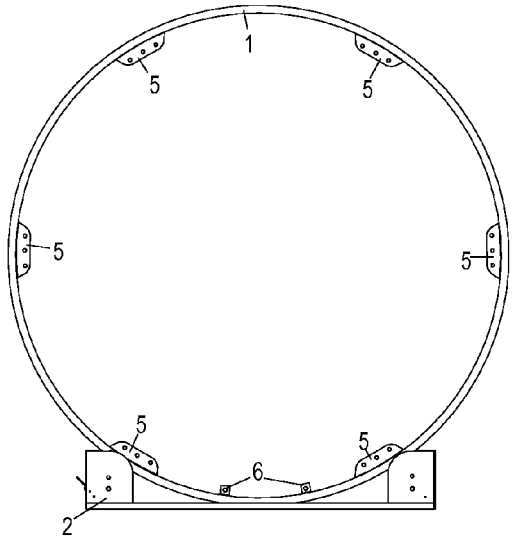
FIG. 4 is a front view of one of the hoops as it is associated with one of the roller-bases.
Figure 5:
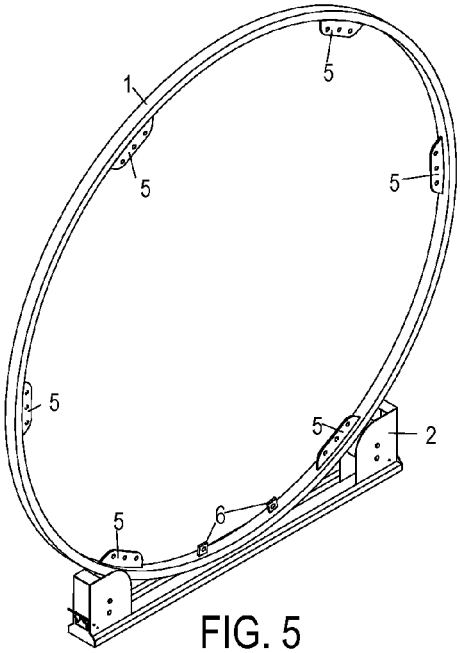
FIG. 5 is similar to FIG. 4 showing a perspective view.
Figure 7:
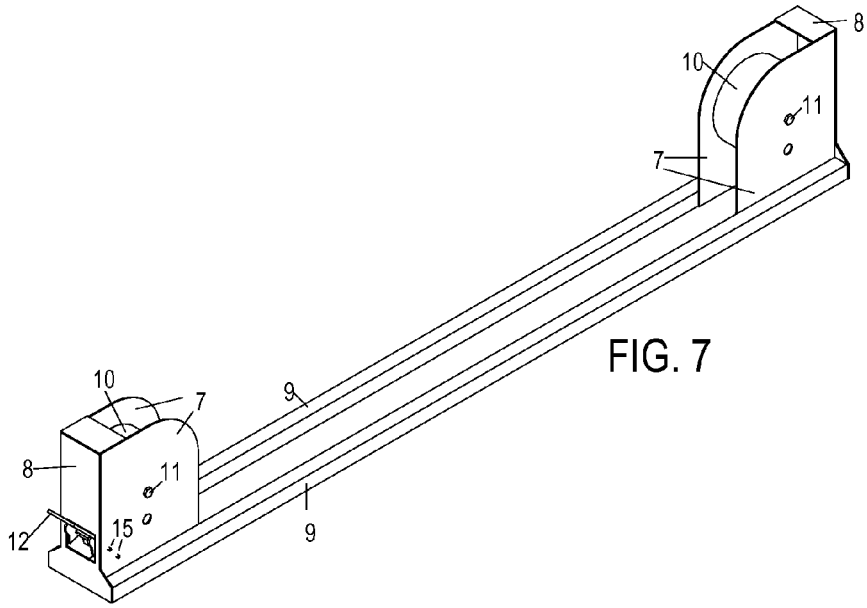
FIG. 7 is a perspective view of one of the roller-bases.
Figure 8:
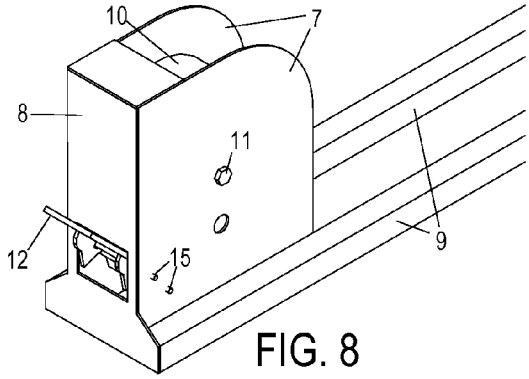
FIG. 8 is a partial perspective view of one end of one of the roller-bases.
Figure 9:
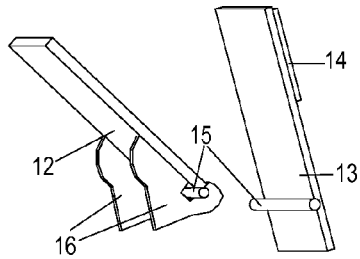
FIG. 9 is a perspective view of the brake pedal and brake pad mechanism parts.

As shown in FIGS. 4 and 5, the hoop 1 is rotatably supported on the center of the roller-base assembly 2 which is generally stationary on the ground. As best shown in FIG. 7 each roller-base assembly 2 comprises of four vertical support plates 7 which are parallel and spaced apart with two on each end of the roller-base 2. Each pair of support plates 7 are connected on the end edge by an end plate 8 and then each end of the roller-base 2 are joined together by two equal lengths of tubing 9. Each end of the roller-base assembly 2 holds in its center a roller bearing wheel 10 which is supported by a large bolt 11 held by the two support plates 7. Each wheel 10 has a braking mechanism that when engaged slows the wheel 10 from spinning and then locks in place to keep the wheel 10 stationary. The braking mechanism comprises of a brake pedal 12 and a brake pad plate 13. The brake pedal 12 is attached to two wedge plates 16 and a bolt shaft 15. The brake pad 14 is mounted to the brake pad plate 13 which is attached to bolt shaft 15 as shown in FIG. 9. The bolt shafts 15 are supported in the support plates 7 and allow the brake pedal assembly and the brake pad plate assembly to pivot when the brake pedal assembly is applied or released.

Figure 10:
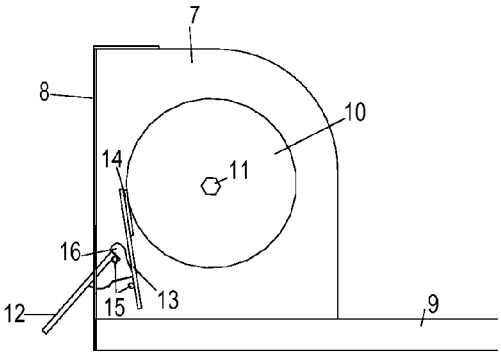
FIG. 10 is a side view of a section of one end of the roller-base, showing the brake mechanism in the off position.
Figure 11:
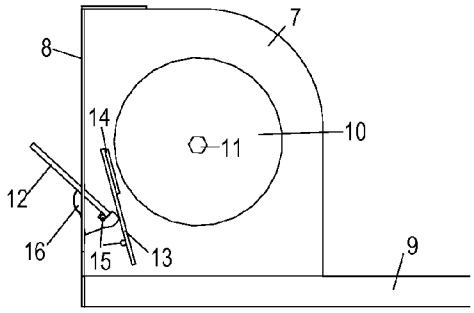
FIG. 11 is a side view of a section of one end of the roller-base, showing the brake mechanism in the on position.

The brake pedal 12 extends through an opening in the end plate 8 and when pressed down, the wedge plates 16 press against the brake pad plate 13 which pivots on bolt shaft 15 and presses the brake pad 14 against the wheel 10 as shown in FIG. 10. When the brake pedal 12 is released or pushed up, the assembly pivots on bolt shaft 15 and the wedge plates 16 slide against the brake pad plate 13 causing it to pivot and the brake pad 14 to lose contact with the wheel 10 allowing it to spin freely.

Figure 12:
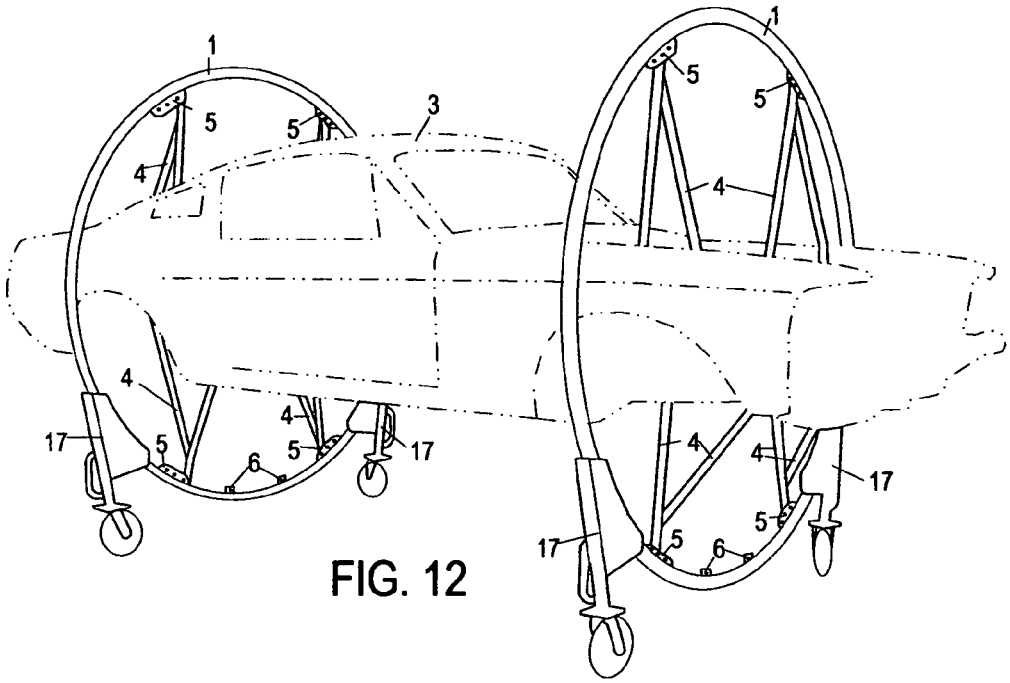
FIG. 12 is an overall perspective view of the apparatus including the upright rolling supports as associated with a vehicle body shell.
Figure 15:
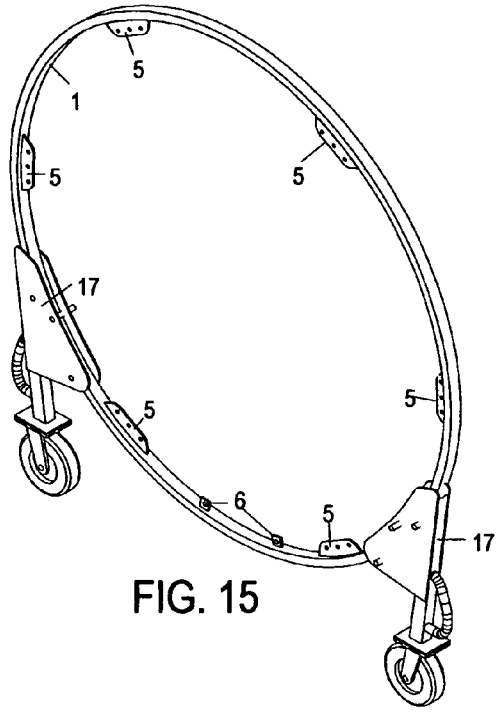
FIG. 15 is similar to FIG. 14 showing a perspective view.
Figure 16:
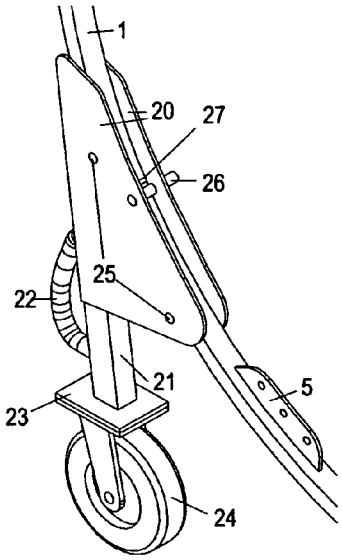
FIG. 16 is a partial perspective view of the upright rolling support as it attaches to the hoop.
Figure 17:
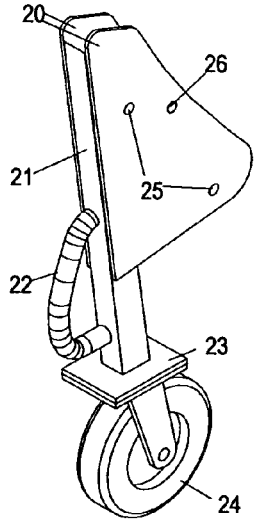
FIG. 17 is a perspective view of the upright rolling support.

The apparatus can be moved around an area when attached to the upright rolling support assemblies 17 as shown in FIG. 12. The upright rolling supports 17 attach to the hoops 1 at each lower edge. Each upright rolling support 17 comprises of two vertical leg supports 20 which are spaced apart equal to the width of the hoop 1. The vertical leg supports 20 are joined by a leg pillar 21 and the castor wheel 24 is attached to the leg pillar 21 by a castor plate 23 welded or otherwise secured to the bottom edge of the leg pillar 21. A handle 22 is attached to the outside edge of leg pillar 21 to aid in the connection and removal of the upright rolling support 17 to the edge of the hoop 1. The vertical leg supports 20 are designed to tightly fit around the side edges of the hoop 1 as shown in FIGS. 15 and 16. The outside edge of the hoop 1 is supported on two bolts 25 that are mounted in the vertical leg supports 20. The pin lock 26 rests on a weld bead 27 on the inside edge of the hoop 1 to firmly lock the upright rolling support 17 in place on the hoop.

Figure 13:
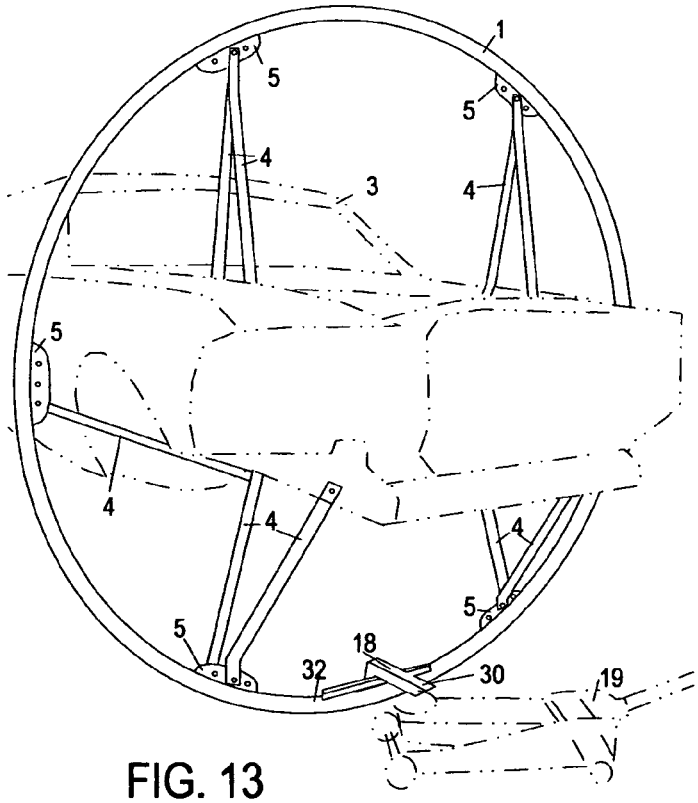
FIG. 13 is a partial perspective view of the front section of a vehicle body shell in a hoop that is being lifted by a floor jack pressing up on the jacking-arm.
Figure 14:
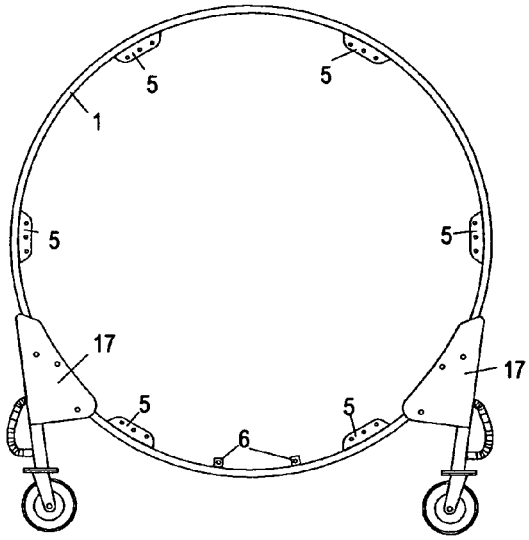
FIG. 14 is a front view of one of the hoops as it is associated with the upright rolling supports.
Figure 18:
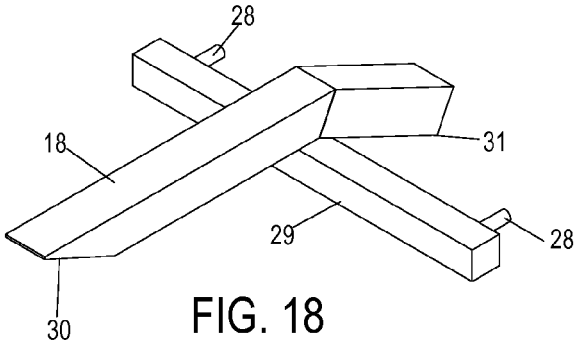
FIG. 18 is a perspective view of the jacking-arm.
Figure 19:
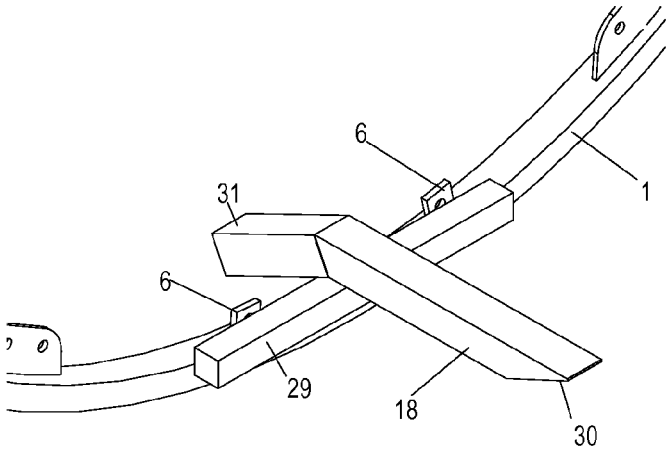
FIG. 19 is a partial perspective front view of the jacking-arm as it associates with the tabs on the bottom edge of the hoop.
Figure 20:
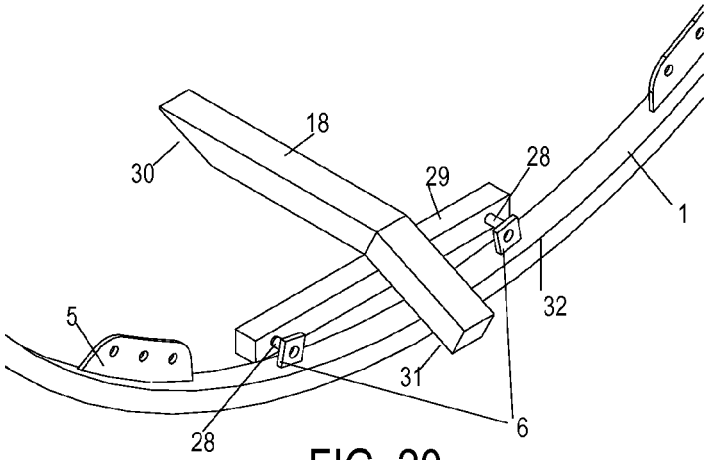
FIG. 20 is similar to FIG. 19 showing the view from the rear of the hoop and jacking-arm.

FIG. 18 shows the jacking arm mechanism 18 which comprises of two pins 28 that are welded or otherwise secured to each end of a length of tubing 29 and attached at a right angle to another length of tubing 30 with one end bent at an angle downward 31. As shown in FIGS. 19 and 20, the pins 28 on the jacking arm 18 insert into the jacking arm tabs 6 on the lower inside edge of the hoop 1. As shown in FIG. 13 the user lifts the end 30 with a floor jack 19 which causes end 31 to press against the edge of the hoop 32, which then compresses the pins 28 in the jacking arm tabs 6 and allow the user to raise and lower the hoops onto the roller bases 2 and/or to attach the upright rolling supports 17.

We claim:

1. A method of supporting, rotating and transporting a vehicle body shell comprising the steps of:

(a) positioning a vehicle body shell within a pair of generally parallel hoops vertically oriented with said hoops being spaced apart for rotation about a horizontal axis;

(b) securing said vehicle body shell within each hoop with a plurality of connecting members attachably mounted from the inner edge of said hoop to said vehicle body shell to form a rotatable assembly;

(c) positioning said assembly on a pair of generally stationary supporting frames, said frames each having a pair of rollers aligned to support each of said hoops of said assembly for rotation;

(d) rotating said assembly by manually rotating one of said hoops over said rollers, thereby allowing the assembly to rotate 360°;

(e) halting rotation of said assembly by engaging one of a plurality of friction brakes which engage said rollers and prevent the rotation of said hoops thereby, stabilizing said assembly to perform repairs on said vehicle while said assembly's rotation is stopped and positioned in any angle;

(f) lifting said assembly from contact with said rollers of said generally stationary supporting frames by removably securing an attachable lifting member which engages a receiving means mounted on the inner edge of each of said independent generally parallel hoops, enabling each of said pair of independent generally parallel hoops to be elevated when said attachable lifting member is raised by a lifting mechanism, thereby enabling said generally stationary supporting frames to be removed from under said assembly;

(g) attaching a plurality of removably connected rolling supports, configured to engage with said assembly by removably attaching to each lower side of each of said independent generally parallel hoops a pair of the removably connected rolling supports to a lower outer edge of each of said hoops, thereby enabling said assembly to be moved around an area or up or down an incline of up to 25 degrees.

* * * * *